United States Patent [19]

Ishii et al.

[11] Patent Number: 4,495,914

[45] Date of Patent: Jan. 29, 1985

[54] ELECTRIC GOVERNOR

[75] Inventors: Yoshiya Ishii, Toyota; Shuji Hachitani, Anjo; Yasushi Tanaka, Kariya, all of Japan

[73] Assignee: Nippondenso Co., Ltd., Kariya, Japan

[21] Appl. No.: 373,782

[22] Filed: Apr. 30, 1982

[30] Foreign Application Priority Data

May 7, 1981 [JP] Japan ..... 56-68950

[51] Int. Cl.[3] ..... F02D 1/04; F02D 1/06

[52] U.S. Cl. ..... 123/357; 123/373; 123/198 DB; 123/372

[58] Field of Search ..... 123/357, 359, 198 DB, 123/373, 372, 364

[56] References Cited

U.S. PATENT DOCUMENTS 1,411,631 4/1922 Jorbensen ..... 123/357

4,318,378 3/1982 Eheim ..... 123/357

FOREIGN PATENT DOCUMENTS 734978 10/1932 France ..... 123/373

*Primary Examiner*—Charles J. Myhre

*Assistant Examiner*—Carl Stuart Miller

*Attorney, Agent, or Firm*—Cushman, Darby & Cushman

[57] ABSTRACT

An electric governor of the type, in which the fuel injection regulating member of a fuel injection pump is driven by means of a solenoid type electromagnetic actuator. The governor includes a link mechanism being rotatably attached to the casing of the governor. In the link mechanism, the electromagnetic actuator is connected to its first point, the fuel injection regulating member is connected to its second point, and the force of a spring for acting against the attraction of the electromagnetic actuator is exerted upon its third point.

1 Claim, 3 Drawing Figures

ELECTRIC GOVERNOR

FIELD OF THE INVENTION

The present invention relates to an electric governor of fuel injection pump for an internal combustion engine, especially, a Diesel engine.

DESCRIPTION OF THE Prior Art

Most of the conventional governors using a solenoid type electromagnetic actuator are constructed such that there is disposed in the electromagnetic actuator a spring for generating a force which acts against the attraction of the electromagnetic actuator. In some of the governors, on the other hand, there is disposed outside of the electromagnetic actuator a spring for generating the force which acts against the attraction of the electromagnetic actuator. Those springs are restricted to one which is arranged in the same direction as the moving direction of a fuel injection regulating member thereby to counteract the attraction of the electromagnetic actuator through the fuel injection regulating member.

Moreover, the construction, in which the spring is disposed in the electromagnetic actuator, has the following defects. First of all, since there is a limit in the spring mounting size of the electromagnetic actuator, there is little degree of freedom in the design of the spring. Next, since it is intended to retain a space for mounting the spring, the attracting area of a magnetic member is reduced to reduce the attraction, and the spring may occasionally exert an undesired influence upon the magnetic field thereby to reduce the attraction. Moreover, it is remarkably difficult to effect the adjustment of the mounting load upon and the replacement of the spring.

On the other hand, the latter construction, in which the spring is disposed outside of the electromagnetic actuator so that its force may act against the attraction at the output rod of the electromagnetic actuator through the fuel injection regulating member, has the following defects. In this construction, first of all, since the spring mounting position and size are restricted, there is little degree of freedom in the design of the spring. In the construction, moreover, it is also remarkably difficult to effect the adjustment of the mounting load upon and the replacement of the spring.

SUMMARY OF THE INVENTION

It is, therefore, an object of the present invention to increase the attraction of an electromagnetic actuator, to increase the degree of freedom in the design of a spring for generating a force which acts against the attraction of the electromagnetic actuator, and to make it possible to facilitate the adjustment of the spring force and the replacement of the spring.

DESCRIPTION OF THE PREFERRED EMBODIMENT

Figure 1:
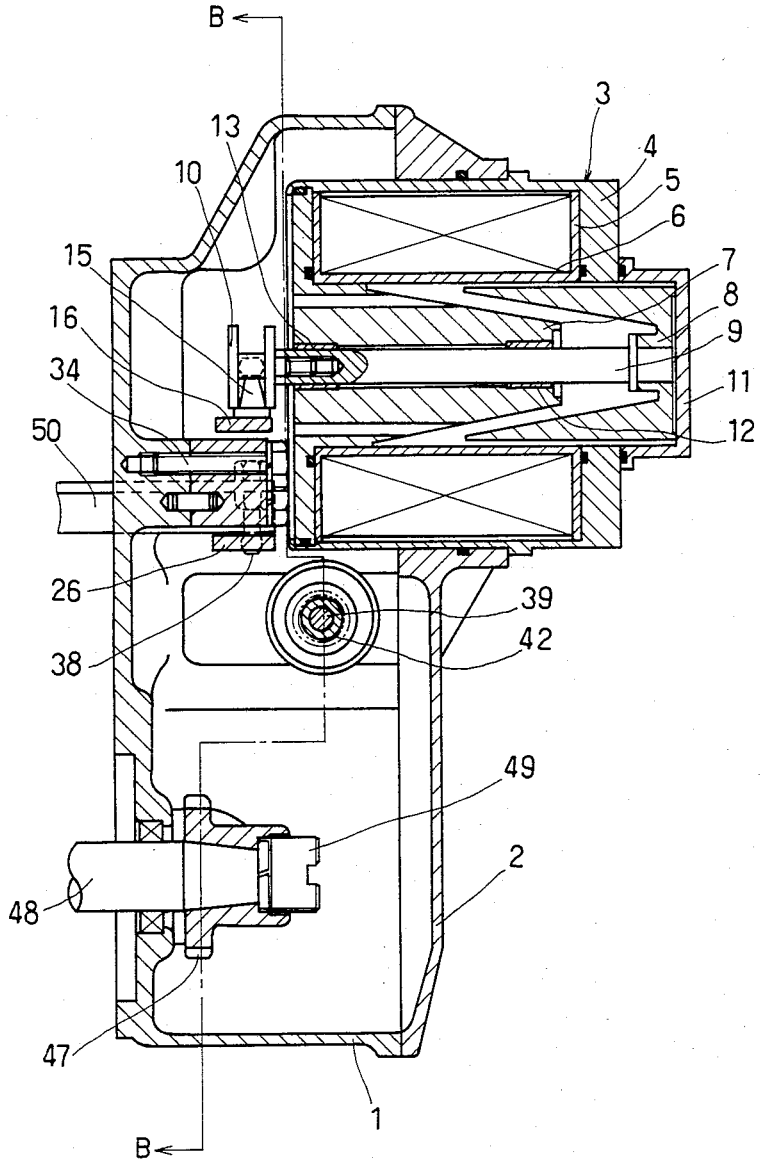
FIG. 1 is a section showing one embodiment of the present invention and taken along line A—A of FIG. 2.
Figure 2:
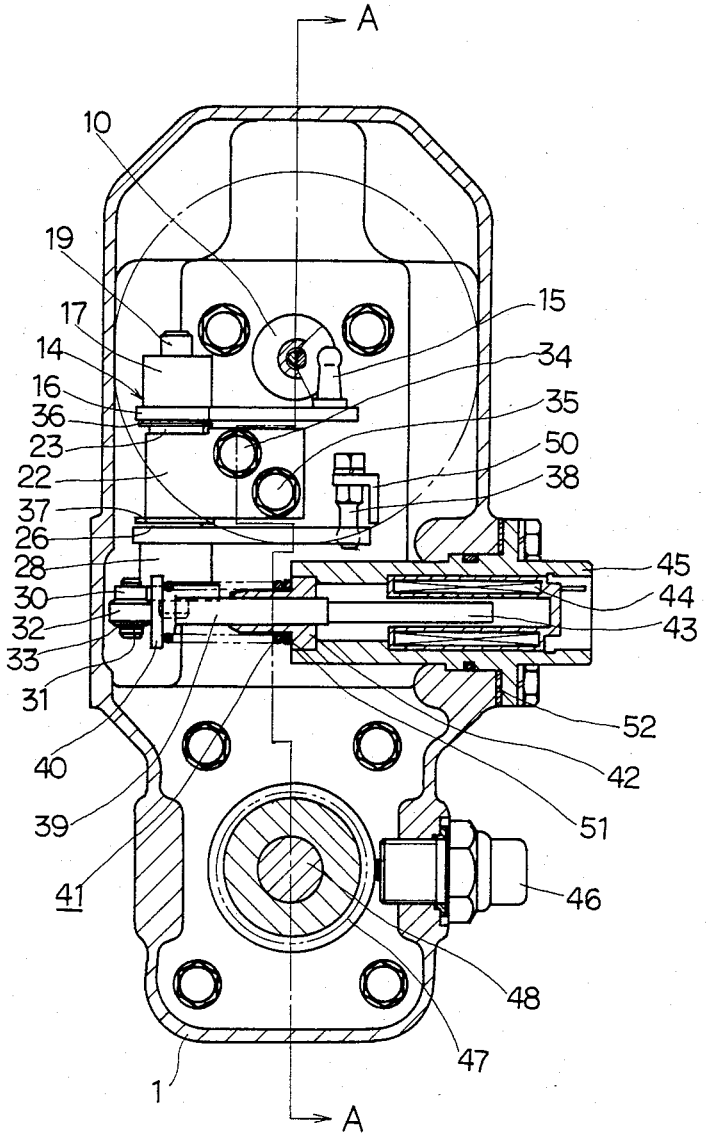
FIG. 2 is a section taken along line B—B of FIG. 1.
Figure 3:
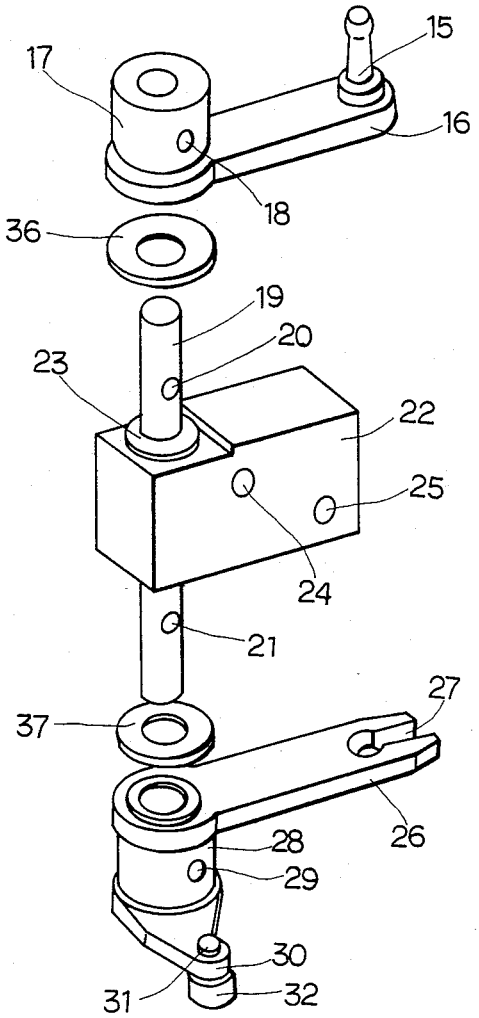
FIG. 3 is an exploded perspective view showing in an enlarged scale the link mechanism shown in FIG. 2.

In FIGS. 1 to 3, reference numeral 1 indicates a governor casing which is fixed to a not-shown fuel injection pump by means of bolts. Numeral 2 also indicates a governor casing which in turn is fixed to the former governor casing 1 by means of not-shown bolts. Numeral 3 indicates a solenoid type electromagnetic actuator, in which a coil 6 of a wire wound on the outer circumference of a bobbin 5 is fixed in a cylindrical casing 4 made of a magnetic material. In the inner wall of the coil 6, there is fixed a stationary core 7 made of a magnetic material, which has its one end formed with a frusto-conical protrusion and has bearings 12 and 13 press-fitted in the center portions of both its ends. In these bearings 12 and 13, moreover, there is borne an output rod 9 such that it can move to the right and left, as viewed in FIG. 1 and can rotate. To one end of this output rod 9, there is fixed a moving core 8 which is made of a magnetic material and which is formed with such a frusto-conical recess as faces the frusto-conical protrusion of the stationary core 7. To the other end of that output rod 9, there is fastened by means of a screw a connecting member 10 which is formed with an annular groove. Numeral 11 indicates a cover which is made of a non-magnetic material and which is fixed to the casing 4 by means of non-shown bolts.

Numeral 14 indicates a link mechanism which has its fulcrum fixed at the governor casing 1 and which has such a construction as is shown in detail in FIG. 3. Numeral 22 indicates a block which is fixed to the governor casing 1 by means of later-described bolts thereby to provide the fulcrum of the link mechanism 14. In the block 22, there is press-fitted a cylindrical bush 23 which provides that fulcrum. The block 22 is formed with holes 24 and 25 for receiving the bolts to be fastened to the governor casing 1. Numeral 19 indicates a cylindrical shaft which is rotatably fitted in the bush 23. Both those ends of the cylindrical shaft 19, which protrude from that block 22, are formed with holes 20 and 21 which are directed to intersect the axis of the shaft 19 at a right angle. Numeral 16 indicates a lever which is made of a metal plate and which has its one end fixed to the other end of a pin 15 having its one end formed into a round portion. To the other end of the lever 16, there is fixed a bush 17 which is formed with both an axial hole for receiving the shaft 19 and a hole 8 intersecting the axial hole at a right angle. Numeral 26 indicates a lever which is made of a metal plate and which has its one end formed with a slit 27 and its other end fixed to one end of a bush 28. Numeral 30 indicates a lever which is made of a metal plate and which has a pin 31 fixed to its one end. Moreover, a roller 32 is rotatably held on the pin 31 by means of a cir-clip 33 (as shown in FIG. 2). The aforementioned lever 30 has its other end fixed to the lever 26 at an angle.

The bush 28 is formed like the bush 17 with both an axial hole for receiving the shaft 19 and a hole 29 intersecting the axial hole at a right angle. The bush 17 is fitted on that portion of the shaft 19, which protrudes upward from the block 22, and is fixed to the shaft 19 by means of a not-shown spring pin such that its hole 18 is aligned with the hole 20 of the shaft 19. The bush 28 is also fitted on that portion of the shaft 19, which protrudes downward from the block 22, and is fixed to the shaft 19 by means of a not-shown spring pin such that its hole 29 is aligned with the hole 21 of the shaft 19. Numerals 36 and 37 indicate clearance adjusting shims which are sandwiched, respectively, between the bush 17 and the block 22 and between the bush 28 and the block 22.

In FIG. 2, numerals 34 and 35 indicate bolts which fasten the block 22 to the governor casing 1. Numeral 38 indicates a pin which has its one end formed into a round portion and its other end fixed to a fuel injection regulating member 50. The round portion of the pin 38 is fitted in the slit 27 of the lever 26 so that the motions of the lever 26 are transmitted through the pin 38 to the fuel injection regulating member 50. Numeral 39 indicates a cylindrical rod which has its one end formed with a stepped portion 40 and which has a core 43 of a position sensor fixed to its other end. The roller 32 abuts against one side of the stepped portion 40 whereas a spring 41 abuts against the other side. Numeral 45 indicates a casing which is fixed to the governor casing 1 by means of bolts. To one end of that casing 45, there is fixed a hollow bush 42, in which the rod 39 is slidably and rotatably held. The spring 41 is sandwiched under compression between the stepped portion 40 of the rod 39 and the bush 42. Numeral 51 indicates a shim for adjusting the mounting load of the compression spring 41. In the casing 45, there is fixed an inductance changing type non-contact position detector 44 having a hole, in which there is arranged the core 43 such that it can linearly move. Numeral 52 indicates a shim for adjusting the relative positions of the core 43 and the position detector 44. Numeral 48 indicates the cam shaft of a not-shown fuel injection pump. Numeral 47 indicates a disc which is made of a magnetic material, which is fixed to one end of the cam shaft 48 by means of a round nut 49 (as shown in FIG. 1) and which has its outer circumference formed with equi-distantly spaced grooves. Numeral 46 indicates an electromagnetic pickup which has its leading end fixed to the governor casing 1 while being spaced at a predetermined distance from the outer circumference of the disc 47. Although not shown, moreover, the fuel injection regulating member 50 is equipped for the purpose of preventing the chattering with a compression spring which has a weaker spring force than that of the spring 41 and which is sandwiched between the housing of the not-shown fuel injection pump and the pin 38 thereby to always thrust the fuel injection regulating member in a direction to reduce the fuel injection rate (i.e., rightwardly of FIG. 1).

With construction thus far described, when the coil 6 of the electromagnetic actuator 3 is energized, the moving core 8 is attracted by the resultant magnetic force toward the stationary core 7 so that it moves leftwardly of FIG. 1. The movement of that moving core 8 is transmitted to the output rod 9 which is fixed to the moving core 8. This movement of the output rod 9 is transmitted through the connecting member 10 and the pin 15 to the lever 16 and further through the shaft 19 to the lever 30 which is made rotatable integrally with the lever 16. This motion of the lever 30 is converted through the pin 31 and the roller 32 into the linear movement of the rod 39 thereby to compress the compression spring 41 which is in abutment contact with the stepped portion 40 of the rod 39. On the contrary, this force of the spring 41 is transmitted through the stepped portion 40, the roller 32, the pin 31, the lever 30, the shaft 19, the lever 16, the pin 15, the connecting member 10 and the output rod 9 to the moving core 8, so that the moving core 8 and the output rod 9 reside at positions where the attraction and the spring force are balanced. On the other hand, the fuel injection regulating member 50 is connected through the pin 38 to the lever 26, which in turn can swing together with the lever 16 through the shaft 19 similarly to the lever 30, so that the regulating member 50 is shifted in accordance with the position of the output rod 9. As a result, the position of the fuel injection regulating member 50 can be controlled in accordance with the level of the current to flow through the coil 6 of the electromagnetic actuator 3 thereby to regulate the fuel injection rate of the fuel injection pump.

In the embodiment, as shown, the movement of the output rod 9 in the leftward direction, as viewed in FIG. 1, in case the electromagnetic actuator 3 is energized, is transmitted as the leftward motion of the fuel injection regulating member 50, i.e., as the motion in a direction to increase the fuel injection rate. In case the electromagnetic actuator 3 is deenergized, on the contrary, the fuel injection regulating member 50 shifts in the rightward direction of FIG. 1. i.e., in a direction to reduce the fuel injection rate to zero. As a result, in case the current to the electromagnetic actuator is interrupted by an accident, the fuel injection rate can be reduced to zero thereby to prevent the engine from excessively rotating. On the other hand, the core 43 fixed to the rod 39 conducts the linear movements integrally with the rod 39 so that the output of the inductance changing type position sensor 44 becomes such an output as varies in accordance with the position of the fuel injection regulating member 50 which is made coactive with the rod 39. By feeding that output to a not-shown electric control circuit, it is enabled to effect the position control. Moreover, since a signal having a frequency proportional to the r.p.m. of the engine can be generated by the coactions between the disc 47 and the electromagnetic pickup 46, the engine r.p.m. cam be controlled in a fed-back manner by feeding that signal to the not-shown control circuit. The casing 45 is fixed to the governor casing 1 by means of bolts so that it can be mounted and demounted from the outside of the governor casing. As a result, it is possible to replace the spring 41 and the shim 51, and it is easy to change the spring constant for coping with the attraction of the electromagnetic actuator 3 and to adjust the mounting load.

Although, in the embodiment thus far described, the link mechanism 14 is constructed of an integrally movable one, it may be composed of a plurality of such links as can move respectively but together such that the respective links are swung in arbitrary planes.

Moreover, since the bush 42 is fixedly press-fitted in the casing 45, it may be fixedly fastened to the casing 45 by means of screws and nuts, for example, so that it can be moved to adjust the mounting load of the spring 41.

Still moreover, the position sensor 44 to be used may be of a resistance changing contact type.

As has been described hereinbefore, according to the present invention, by disposing outside of the electromagnetic actuator the spring for generating the force which acts against the attraction of the electromagnetic actuator, this attraction can be increased while facilitating the design of the spring. By making such a mechanism as causes the force of the spring to counteract the attraction of the electromagnetic actuator through the link mechanism, the restriction to the mounting position of the spring is reduced so that the spring can be arranged at a position, where its interference with the parts of the engine body is obviated, and the spring having its force adjusted can be easily replaced from the outside of the governor.

What is claimed is:

1. An electric governor for attachment to a fuel injection pump for an internal combustion engine, the pump having an elongated movable fuel injection regulating member and a cam shaft, comprising:

a governor casing attachable to the fuel injection pump with the regulating member and the cam shaft projecting into said governor casing;

a solenoid type electromagnetic actuator fixed to said governor casing including a first coil, the axis of which is substantially parallel to the regulating member, and an output rod which is inserted into said coil to be substantially parallel to the regulating member, said output rod being movable axially in response to an electric signal to be applied to said coil;

a position detector detachably secured to said casing transversely of the regulating member, said first coil and said output rod, and including a second coil and a core which are positioned transversely of the regulating member, said first coil and said output rod, said core being movable reciprocally in said second coil and extending from said position detector into said casing, said position detector being removable from said casing from the exterior thereof, a link mechanism positioned in said casing between said output rod and said core with the regulating member therebetween, said mechanism including:

a block detachably fixed to said casing;

a shaft extending through said block, said shaft being positioned at a side of said output rod opposite said position detector and at a side of the regulating member remote from said actuator;

a first lever connected between said output rod and said shaft to transmit reciprocal movements of said output rod to said shaft to oscillate the latter, said first lever being substantially in transverse relationship to said output rod;

a second lever positioned between said shaft and the regulating member to transmit oscillating movements of said shaft to the regulating member to reciprocate the latter, said second lever being substantially parallel to said first lever; and a third lever positioned between said shaft and said core of said position detector to transmit oscillating movements of said shaft to said core to reciprocate the latter, said third lever being substantially normal to said first and second levers;

a spring supported by said position detector and said core in such a manner that said spring biases said third lever so as to balance with the electromagnetic force generated by said electromagnetic actuator; and an electromagnetic pick-up fixed to said casing for detecting the rotational speed of the cam shaft, an electric signal from said pick-up being used to energize said first coil of said electromagnetic actuator.

* * * * *